US006016050A

United States Patent [19]

Brokaw

[11] Patent Number: 6,016,050

[45] Date of Patent: Jan. 18, 2000

[54] START-UP AND BIAS CIRCUIT

[75] Inventor: A. Paul Brokaw, Burlington, Mass.

[73] Assignee: Analog Devices, Inc., Norwood, Mass.

[21] Appl. No.: 09/111,064

[22] Filed: Jul. 7, 1998

[51] Int. Cl.[7] ..... G05F 3/20; G05F 1/10; G05F 3/02

[52] U.S. Cl. ..... 323/315; 323/316; 327/540; 327/563

[58] Field of Search ..... 323/315, 312, 323/316, 313, 314; 307/310, 297; 327/540, 563, 538

[56] References Cited

U.S. PATENT DOCUMENTS

| | | | |
|---|---|---|---|
| 4,673,830 | 6/1987 | Giorgetta et al. | 307/297 |
| 4,677,380 | 6/1987 | Popovic et al. | 324/252 |
| 5,034,626 | 7/1991 | Pirez et al. | 307/296.7 |
| 5,315,231 | 5/1994 | Linder et al. | 323/315 |
| 5,694,031 | 12/1997 | Stanojevic | 323/313 |
| 5,886,570 | 3/1999 | Brokaw | 327/540 |

*Primary Examiner*—Peter S. Wong
*Assistant Examiner*—Rajnikant B. Patel
*Attorney, Agent, or Firm*—Koppel & Jacobs

[57] ABSTRACT

A start-up and bias circuit provides a known, fixed bias point suitable for generating fixed bias currents for use in other circuits, which remains fixed regardless of variations in a start-up signal. A first transistor conducts a current in response to the start-up signal, which is mirrored to a second transistor driven from a node that increases linearly with the conducted current. When the conducted current reaches a predetermined threshold, the second transistor sinks all of the mirrored current and the operating point of the first transistor stabilizes. A third transistor is connected to oppose increases in the start-up signal beyond that required to maintain the predetermined threshold current. When stabilized, the virtually constant current in the first transistor provides a fixed bias point; a number of other transistors can be connected to the bias point to mirror the constant current and thereby produce individual fixed bias currents for use in other circuits. A thermal shutdown circuit uses the difference in the base-emitter voltages of a pair of differently-sized transistors to indicate an excessive temperature condition, which can be used, for example, to reduce the bias current supplied to a voltage regulator to near zero.

30 Claims, 5 Drawing Sheets

START-UP AND BIAS CIRCUIT

BACKGROUND OF THE INVENTION

1. Field of the Invention

This invention relates to the field of start-up circuits, and particularly to start-up circuits which, in response to a start-up signal, provide a means of generating fixed bias currents suitable for use in other circuits.

2. Description of the Related Art

Analog circuitry typically employs a number of fixed current sources, used, for example, to provide bias currents and establish voltage or current limits. An example of a circuit that requires a fixed bias current is the voltage regulator shown in FIG. 1. An input voltage $V_{in}$ is connected to the emitter 10 of a pass transistor 12, typically a pnp bipolar transistor, and an output voltage $V_{out}$ is taken at the transistor's collector 14 and drives a load $R_{load}$. The output voltage is regulated by controlling pass transistor 12 via its control input 16. Regulation is accomplished with a feedback loop: the output voltage is fed back to a loop amplifier 18, usually via a voltage divider 20. A voltage reference $V_{ref}$ is also connected to the amplifier, which produces an output proportional to the difference between its two inputs. The amplifier's output is connected to a drive circuit 22, which produces the drive signal that controls the pass transistor 12.

The drive circuit 22 includes a drive transistor $Q_{drive}$, which produces a drive current $i_{drive}$ used to control pass transistor 12. The base of $Q_{drive}$ is driven from the emitter of a buffer transistor $Q_b$, which is in turn driven by a bias current $i_{bias}$. $Q_b$'s base is also connected to the collector of an inverting transistor $Q_{inv}$, which is driven by the output of amplifier 18 via an emitter follower transistor $Q_a$. A resistor Ra is connected between the base of $Q_{inv}$ and the base of $Q_{drive}$. The emitters of transistors $Q_b$ and $Q_a$ are pulled down with respective current sources i2 and i1.

A well-controlled, known bias current $i_{bias}$ is important to the operation of the regulator. Drive current $i_{drive}$ is controlled by amplifier 18, until it reaches a maximum value that depends in part on $i_{bias}$. Assuming that i1 and Ra are fixed values, the maximum drive current $i_{drive}$(max.) is given by:

$$i_{drive}(\text{max.})=i_{bias}\times e^{(i1\times Ra)/(kT/q)}$$

When $i_{drive}$(max.) is appropriately set, it protects the pass transistor from being overdriven. In this exemplary analog circuit, establishing a precise drive current limit requires that $i_{bias}$ be a known, fixed value. A well-controlled $i_{bias}$ is also important when $i_{drive}$ is below the maximum, so that amplifier 18 can provide as much drive as may be needed for normal operation.

Many analog circuits, including some voltage regulators, are designed to become active upon receipt of a "start-up" signal, which can be a voltage, a current, or a logic signal, for example. Start-up signals are often derived from unregulated voltage sources, making the generation of fixed bias currents directly from the start-up signal impractical. A need exists for a circuit that can generate multiple known, fixed bias currents upon receipt of an unregulated or varying start-up signal.

SUMMARY OF THE INVENTION

A start-up and bias circuit is presented which meets the needs noted above. Upon receipt of a start-up signal, the circuit provides a known, fixed bias point which can be used to generate a number of fixed bias currents suitable for use in other circuits. The bias point remains fixed regardless of variations in the start-up signal as long as the start-up signal stays above a particular threshold. A thermal shutdown circuit is also presented which can reduce selected bias currents to near zero if a temperature in excess of a settable threshold is detected.

The invention is preferably implemented with a first transistor that is driven to conduct a current in response to the start-up signal. The current is mirrored to a second transistor, which is driven from a node voltage that increases linearly with the conducted current. When the conducted current reaches a predetermined threshold, the second transistor is driven to sink all of the mirrored current. A third transistor is connected to divert start-up signal current away from the first transistor in accordance with the magnitude of the current sunk by the second transistor, to oppose increases in the start-up signal beyond that required to sustain the predetermined threshold current.

The operating point of the first transistor stabilizes when the second transistor is driven to sink all of the mirrored current. When stabilized, the current through the first transistor remains nearly constant at the predetermined threshold, with variations in the start-up signal countered by the third transistor. The virtually constant current in the first transistor provides a fixed bias point; a number of other transistors can be connected to the bias point to mirror the constant current, and thereby produce individual fixed bias currents for use in other circuits.

The thermal shutdown circuit adds a fourth transistor to the start-up and bias circuit, which has an emitter area greater than that of the second transistor, and thus a lower base-emitter voltage. The fourth transistor's collector receives a fixed bias current and its base is driven with a voltage divided down from that driving the second transistor, so that the fourth transistor conducts a lesser current at normal operating temperatures. At elevated temperatures, however, the difference in base-emitter voltages narrows and the current in the fourth transistor begins to increase rapidly as a settable temperature threshold is neared. At the threshold temperature, the currents in the two transistors become equal and the fourth transistor's collector voltage is pulled low. This drop in voltage is used to indicate an excessive temperature condition, and can be used, for example, to reduce selected bias currents to near zero.

The start-up and bias and thermal shutdown circuits are advantageously employed, for example, in a voltage regulator, providing a reliable, controlled means of activating the regulator and providing its bias currents, as well as shutting down the regulator and protecting it from damage due to excessive temperature.

Further features and advantages of the invention will be apparent to those skilled in the art from the following detailed description, taken together with the accompanying drawings.

DETAILED DESCRIPTION OF THE INVENTION

Figure 2:
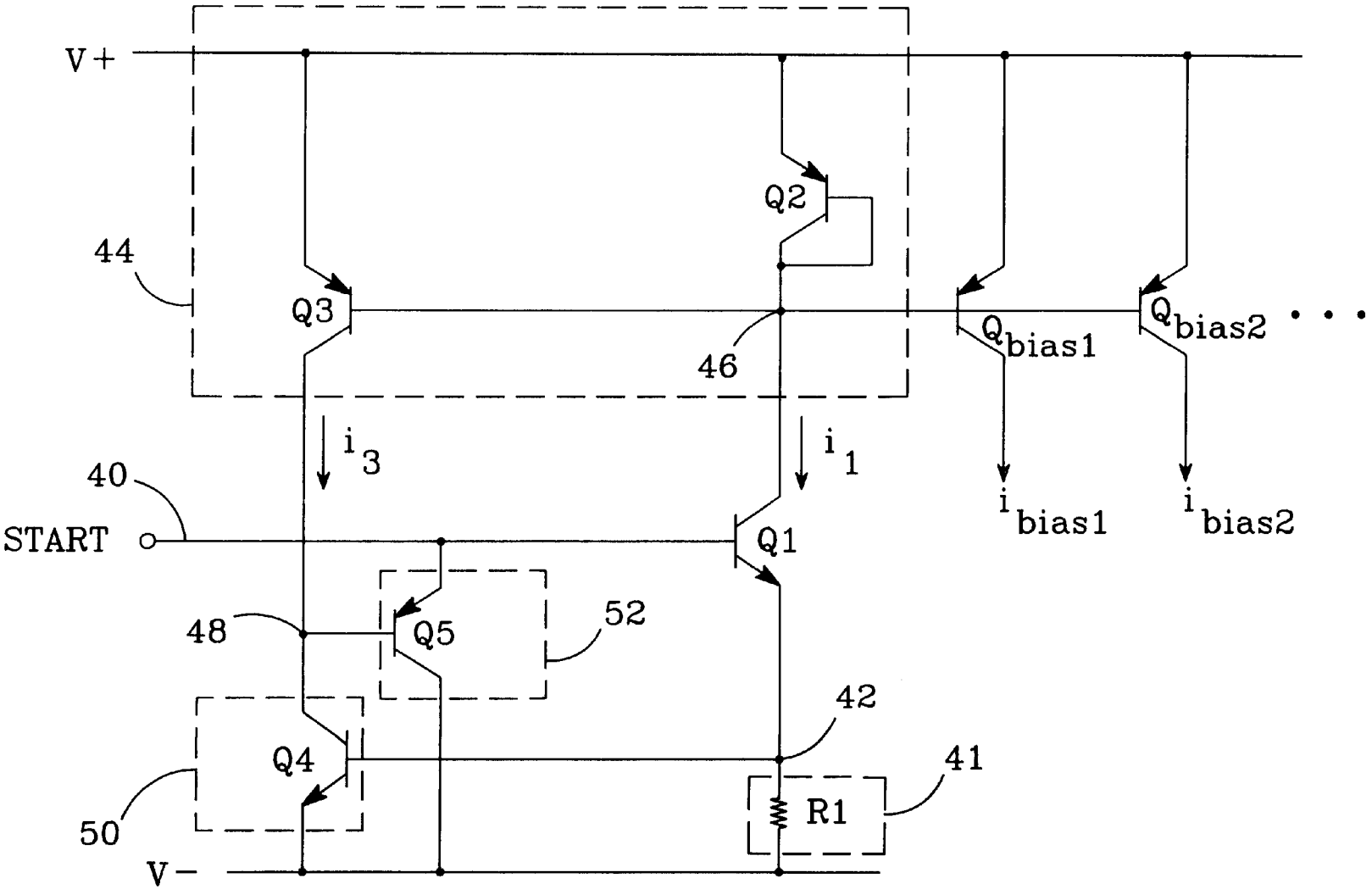
FIG. 2 is a schematic diagram of a start-up and bias circuit per the present invention.

A start-up and bias circuit which provides a fixed bias point in response to the receipt of a start-up signal is shown in FIG. 2. A start-up signal START is received at an input 40, and is connected to the control input of a transistor Q1; Q1 is shown here as an npn bipolar transistor, though alternative implementations (discussed below) are possible. A resistance 41, here implemented with a resistor R1, is connected between Q1's emitter—at a node 42—and a supply voltage V−, which is typically ground. Q1's collector is connected to a current mirror circuit 44, suitably implemented with two transistors Q2 and Q3. The base and collector of diode-connected transistor Q2 and the base of a transistor Q3 are connected to Q1's collector at a node 46, with Q2's and Q3's emitters connected together and to a supply voltage V+; Q1's mirrored collector current appears at the collector of Q3 as current $i_3$. As described herein, the start-up circuit acts to maintain the voltage at node 46 nearly constant despite variations in the START signal, so that fixed bias currents suitable for use in other circuits can be generated via connection to node 46.

A current sink circuit 50 is preferably implemented with a transistor Q4, shown implemented as an npn transistor. Q4 has its collector connected to Q3's collector at a node 48, with its base connected to the node 42 between Q1's emitter and R1. A current diversion circuit 52 is preferably implemented with a transistor Q5, shown implemented as a pnp transistor. Q5 has its base connected to node 48, its emitter connected to the START signal and its collector connected to V−.

The START signal changes from an "off" state to an "on" state to signal a selected circuit to turn on. Here, the START signal performs this function via the start-up and bias circuit, which generates fixed bias currents for use in the selected circuit upon receipt of the START signal. The START signal can be in the form of a current or a voltage; it is typically near zero when "off", and increases above some threshold when "on". When the START signal level is low, the voltage at the base of Q1 is also low and Q1 is held off. When the START signal increases so that the voltage at Q1's base reaches Q1's base-emitter voltage ($V_{be1}$), Q1 starts to conduct a current $i_1$, which is mirrored by current mirror 44 to transistor Q4. When $i_1$ is low, the voltage developed across R1 at node 42 is also low, and Q4 does not conduct—causing Q3's collector voltage to rise until Q3 saturates. However, as the START signal continues to increase, Q1's emitter voltage will follow, and when the voltage at node 42 reaches Q4's base-emitter voltage ($V_{be4}$), it causes Q4 to conduct and sink some of mirrored current $i_3$.

As the START signal increases further, the voltage at node 42 increases linearly with $i_1$, while the current in Q4 increases exponentially. When Q4 is driven to sink all of the current mirrored by current mirror 44, the start-up circuit comes to equilibrium.

However, START signals are often derived from unregulated sources and tend to fluctuate. If the START signal continues to increase, the current in Q4 will also increase to restore the circuit's equilibrium. Even though Q4's exponentially-increasing current quickly absorbs the additional mirrored current, the voltage at nodes 42 and 46 still varies somewhat with a varying START signal.

The presence of transistor Q5 largely eliminates the variations in the voltage at node 46 caused by a varying START signal. When Q4 begins to sink more of mirrored current $i_3$ and the circuit nears equilibrium, the node 48 voltage begins to go negative. The falling of node 48 pulls down on the base of Q5, which begins to come on and divert current from the START signal to ground. When equilibrium is reached, Q5 buffers the node 48 voltage back to the base of Q1, so that further increases in the START signal current are carried away to ground.

Below the equilibrium current, Q5 is essentially off and does not interfere with the operation of the start-up circuit. Above the equilibrium point, however, Q5 comes on and reduces—by the transistor's current gain beta—the amount of additional current Q4 must sink in response to an excess of START current. This mechanism enables the voltages at nodes 42 and 46 to remain virtually constant even if the START signal is fluctuating, and node 46 can thus be used as a fixed bias point suitable for generating a number of fixed bias currents for use in other circuits (as described below).

The operating point of Q1 stabilizes when its emitter voltage drives the base of Q4 to sink all of mirrored current $i_3$. When this condition is met, Q1's collector current $i_1$ is given by:

$$i_1 = V_{be4}/R1$$

Thus, once $i_1$ increases to a threshold level $i_{th}$, defined as the point at which Q4 is driven to sink all of mirrored current $i_3$, it remains relatively fixed at $i_{th}$—as long as the START signal remains at least high enough to sustain $i_1$ at $i_{th}$. As noted above, increases in the START signal beyond that needed to sustain $i_1$ at $i_{th}$ are largely carried away by Q5, so that variations in the START signal have nearly no effect on $i_1$.

The start-up circuit's operating current changes from a very low level when the START signal is low, and increases to the stabilized level as the voltage at the base of Q1 reaches about two base-emitter voltages ($V_{be1}+V_{be4}$) Lowering the START signal reverses the process and reduces the operating current to the small initial value near the two-$V_{be}$ threshold. When $i_1$ is stabilized at $i_{th}$, the start-up circuit and the bias currents generated from fixed bias point 46 are said to be in their "on" state—meaning that the bias currents are at the levels needed to support the steady state operation of the respective circuits in which they are used; when $i_1$ is not at $i_{th}$, the bias currents are "off".

Fixed bias currents suitable for use by other circuits are generated by employing additional transistors in the same manner as mirror circuit 44 transistor Q3; i.e., with their bases connected to fixed bias point 46 and their emitters connected to V+. Two transistors $Q_{bias1}$ and $Q_{bias2}$ are connected in this way in FIG. 2, and each mirrors the fixed $i_1$ current to produce fixed bias currents $i_{bias1}$ and $i_{bias2}$, respectively. Additional bias currents can be generated as needed, limited only by errors due to the loading effect of the added base currents on the stabilized bias current from Q1. These fixed bias currents can be used by other circuits in a variety of ways well-known to analog circuit designers: to serve as current sources or to establish voltage or current limits, for example.

Various well-known techniques can be used to generate bias currents which are proportional to the current through Q1, rather than identical to it. For example, a desired proportionality can be established between $i_1$ and $i_{bias1}$ and $i_{bias2}$ by fabricating the mirroring transistors $Q_{bias1}$ and $Q_{bias1}$ with different emitter areas than that of Q2.

Transistors Q1–Q5 form a regenerative loop that is started by the START signal increasing Q1's base voltage, and stabilized by the actions of Q4 and Q5. A resistor (as shown in FIG. 3) is preferably placed in Q3's emitter circuit to provide some degeneration, which reduces the gain around the loop so that regeneration is stopped at the stabilization point.

The circuit configuration shown in FIG. 2, in which the START signal is delivered directly to input 40 and the base of Q1, is only advisable if the START signal is in the form of a limited current. There are two base-emitter junctions (those of Q1 and Q4) between input 40 and ground (V−), which will draw large amounts of current if driven beyond about 1.4 volts. If the START signal is a voltage input, some form of current limiting should be used to prevent damaging the circuit. Some exemplary current limiting circuits are discussed in connection with FIGS. 3 and 4 below.

Note that while the start-up and bias circuit is shown implemented with npn and pnp bipolar transistors, an inverted version of the circuit can be realized with the polarities of the transistors and the supply voltages reversed. The circuit could also be suitably implemented with n and p-channel field-effect transistors (FETs) substituted for the npns and pnps, respectively.

Figure 3:
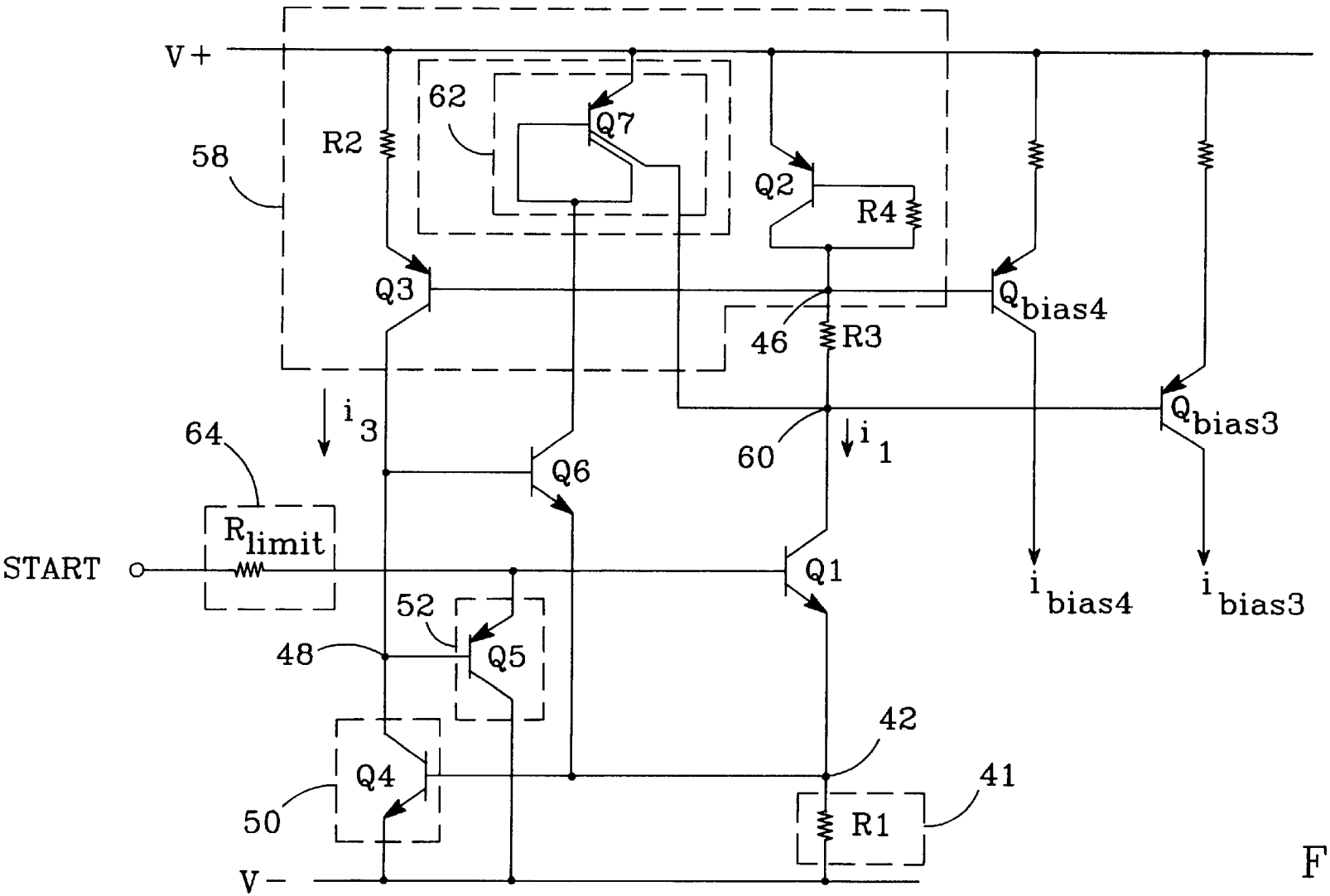
FIG. 3 is a schematic diagram of an enhanced version of a start-up and bias circuit per the present invention.

FIG. 3 is a schematic diagram of an enhanced version of the start-up and bias circuit of FIG. 2. A resistor R2 is preferably placed in the emitter circuit of current mirror transistor Q3 to form a Widlar current mirror 58 (which does not include the circuitry found within the dashed box labeled "62"), to reduce the feedback current and alter its temperature coefficient, and to raise the output impedance of Q3. A resistor R3 is connected between node 46 and the collector of Q1 at a node 60. Assuming Q4 is a bipolar transistor, at the equilibrium point, Q4's base-emitter voltage establishes a complementary-to-absolute-temperature (CTAT) voltage across resistor R1. Since Q1 delivers the current required by R1, its collector current, and thus the across R3, are also CTAT. The voltage at node 60 is slightly larger in magnitude than a base-emitter voltage, but has the same negative temperature coefficient (TC). Bias currents having this temperature characteristic can be generated by connecting the control inputs of one or more transistors to node 60, which then mirror the current through R3 to produce the bias currents. A transistor $Q_{bias3}$ is shown connected to node 60 in this way, which produces a bias current $i_{bias3}$. Bias current-generating transistors can also be connected to node 46: in FIG. 3, a transistor $Q_{bias4}$ is connected to node 46 to generate a bias current $i_{bias4}$. The emitters of both $Q_{bias3}$ and $Q_{bias4}$ are connected to V+, preferably through respective emitter resistors analogous to Q3's emitter resistor R2.

A resistor R4 is connected between the base and collector of Q2 in current mirror 58, which compensates node 46 for the effects of finite beta and the base currents derived from $i_1$.

A transistor Q6 and a current mirror circuit 62 are added to sharpen the threshold at which the circuit becomes stabilized. Transistor Q6, shown implemented with an npn bipolar transistor, has its base connected to the output of current mirror 58, its collector connected to current mirror circuit 62, and its emitter connected to the emitter of Q1. The output of current mirror circuit 62 is connected to the collector of Q1. As Q1 starts to conduct, its current is mirrored via Q3 to the base of Q6. Even a very small current from current mirror 58 will drive Q6 to conduct, with the current in Q6 being mirrored to the collector of Q1 by current mirror circuit 62. This mirrored current will sink the current delivered by Q1, and thereby limit the increase in Q3's current. Thus, with the addition of Q6 and current mirror circuit 62, a low current in Q1 produces an even smaller current in Q3—as well as in the additional transistors such as $Q_{bias1}$ that are connected to mirror Q1's current.

As the START signal continues to increase, the voltage at node 42 will also increase, but the effect of the START signal's increase will be diminished by Q6 and current mirror circuit 62 as described above. At some point, however, the rising voltage at node 42 causes Q4 to start conducting. As Q4 begins to sink the mirrored current $i_3$, it reduces the drive to Q6, permitting the voltage at node 60 to be pulled down by the current in Q1. From this point, the currents in Q3 and in the additional bias current generating transistors such as $Q_{bias1}$ increase with further increases in the START signal, until the stabilization point is reached.

Transistor Q6 and current mirror circuit 62 oppose the turning on of the bias currents at low START signal levels, by reducing the regenerative current from Q3 until the START signal is high enough to cause Q4 to turn on. This effectively extends the start-up signal range for which node 46 is well below the fixed bias point, and serves to better define the minimum voltage required at the base of Q1 needed to achieve the fixed bias point and thereby turn on the bias currents utilized by other circuits.

Transistor Q6 and current mirror circuit 62 provide another benefit: at very high temperatures, leakage currents from the collectors of Q1, Q3, etc. might hold the bias currents partially on. Q6 and current mirror circuit 62 serve to prevent these leakage currents from turning on the bias currents at high temperatures.

Current mirror circuit 62 is suitably implemented with a split-collector transistor Q7 as shown in FIG. 3. One collector of Q7 is diode-connected to its base and to the collector of Q6, and the other collector is connected to node 60; Q7's emitter is connected to V+.

A current-limiting circuit 64, here comprised of a resistor $R_{limit}$, is inserted between the START signal and the base of Q1, to prevent damage to the start-up circuit as described above when the START signal is not in the form of a limited current.

Figure 4:
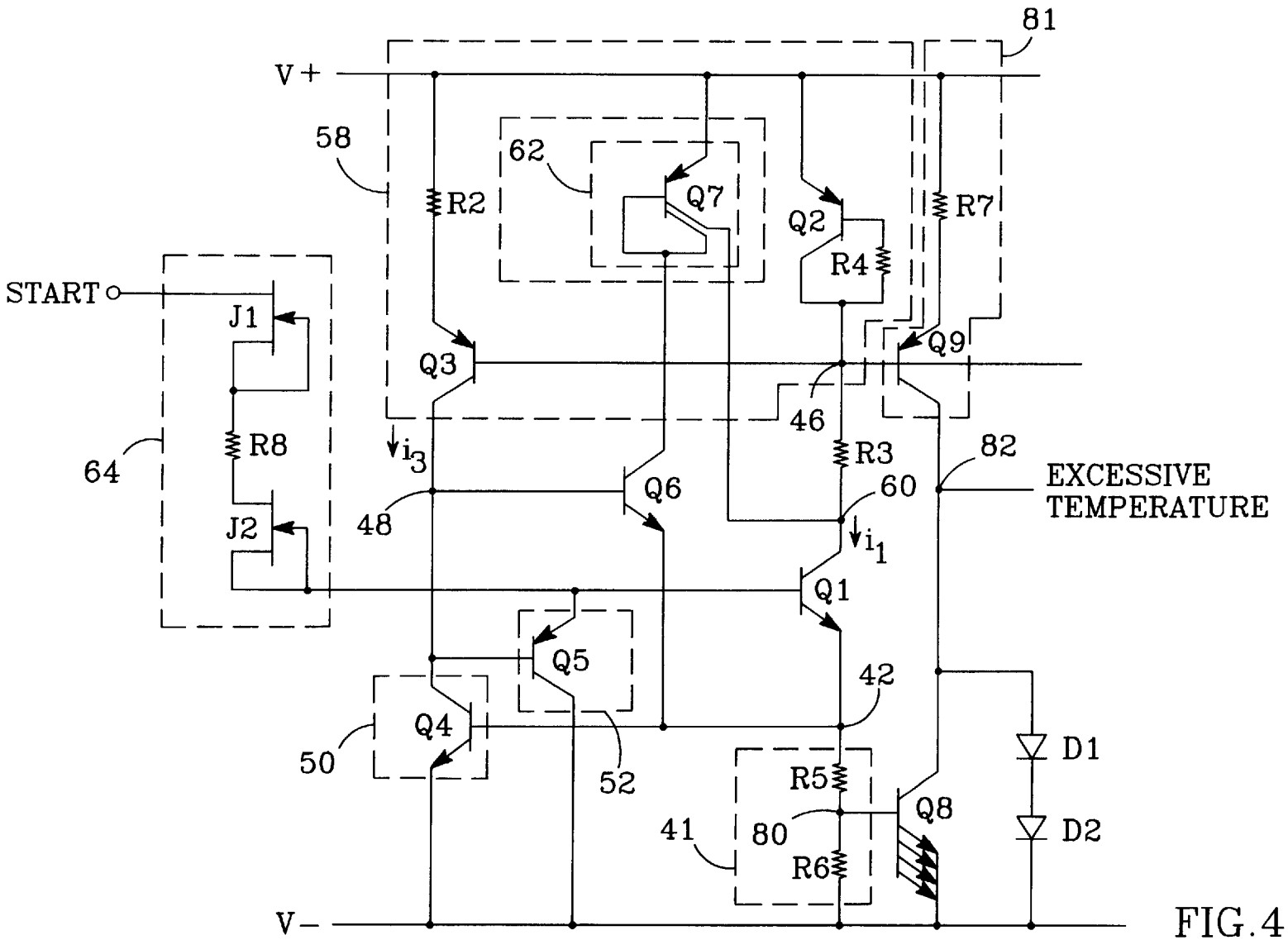
FIG. 4 is a schematic diagram of a start-up and bias circuit and a thermal shutdown circuit per the present invention.

FIG. 4 adds a thermal shutdown circuit to the start-up and bias circuit of FIG. 3. Resistance 41 is implemented with a resistance network, preferably comprised of two resistors R5 and R6 connected in series between node 42 and V−. A node 80 is at an interior node of the network, at the junction of R5 and R6 in this example. The control input of a transistor Q8—preferably the base of a bipolar transistor—is connected to node 80. Because transistor Q4 is driven from node 42 and Q8 is driven from node 80, Q8's base-emitter voltage is necessarily lower than Q4's.

The ratio of the voltage at node 80 with respect to node 42 remains essentially constant over temperature, but because $V_{be}$ falls with increasing temperature, so will the ratio of Q4's current density ($J_4$) to Q8's current density ($J_8$) The The current in Q4 is well-controlled by the start-up and bias circuit. A similarly well-controlled current source 81 is connected to the collector of Q8 at a node 82. If the voltage at node 80 drives Q8 to demand less than the current available from source 81, node 82 will rise; if Q8 is driven to demand current equal to or greater than the current available, node 82 will fall.

Because Q8's base-emitter voltage falls with increasing temperature, the movement of the voltage at node 82 can be used to indicate that Q8 is at or exceeds a predetermined temperature. The voltage at node 80 and the current available from source 81 are selected such that Q8 conducts less than the available current when below the predetermined temperature. However, when the temperature of Q8 is equal to or exceeds the predetermined temperature, the drive to Q8 is sufficient to drive it to conduct all of the available current, causing node 82 to fall. In this way, node 82 is used to indicate that the predetermined temperature, typically a temperature determined to be dangerous to the continued operation of the circuit and thus "excessive", has been reached or exceeded.

One convenient implementation of this temperature indication mechanism is shown in FIG. 4. Q8 preferably has an emitter area that is greater than that of transistor Q4, with both Q4 and Q8 being bipolar. Q8's emitters are connected to V−. The well-controlled current source 81 is made from a transistor Q9 having its base connected to node 46, its emitter connected to V+ through a resistor R7, and its collector connected to the collector of Q8 at a node 82. Q9 provides a well-controlled bias current to Q8, which, like the current provided by Q3 to Q4, is derived from fixed bias point 46 as described above. Thus, Q9 and Q3 are arranged to deliver about equal currents to Q8 and Q4, respectively.

In the circuit of FIG. 4, the emitter area ratio between Q8 and Q4 is made equal to four. The voltage driving Q4 is divided down by R5 and R6, insuring that Q8's base-emitter voltage ($V_{be8}$) is lower than Q4's base-emitter voltage $V_{be4}$, so that Q8 necessarily operates with a lower current density than Q4. At normal operating temperatures, Q8's current density is so low that the current in Q8 is a negligible fraction of the current delivered by Q9, making node 82 "high".

As the temperature in the vicinity of Q4 and Q8 increases, $V_{be4}$ begins to decrease, which also reduces the difference between $V_{be4}$ and $V_{be8}$. At some elevated temperature, this $\Delta V_{be}$ ($=V_{be4}-V_{be8}$) corresponds to a current density of four. When this happens, Q8 draws a current equal to the current in Q4, due to its 4X greater emitter area, and because Q9 is connected to deliver the same current to Q8 as Q3 does to Q4, the current in Q8 will be equal to the current available from Q9. Thus, the voltage at node 82 falls when the temperature necessary to induce equal currents in Q4 and Q8 is reached, and the voltage at node 82 can therefore be used to indicate the occurrence of that "trip point" temperature.

As the temperature increases, the voltage difference between the $V_{be}$'s of Q4 and Q8 is falling, while the voltage difference which allows Q8 to run at the Q9 current is rising. Because one of these functions is falling while the other is rising, the threshold—i.e., the point at which the two functions match and node 82 falls—is fairly sharp.

Q4 and Q8 operate at different current densities, so that the difference in their base-emitter voltages $\Delta V_{be}$ is given by: $\Delta V_{be}=(kT/q)\ln(J_4/J_8)$. The voltage across R5 is equal to $\Delta V_{be}$, so that, with a current density ratio of 4:1 as in the circuit of FIG. 4, node 82 will fall when the voltage across R5 is equal to (kT/q)ln4.

The trip point temperature can be set by adjusting the ratio of R5 to R5+R6. If R5 is made a greater fraction of the resistance 41, the trip point moves up; if R5 is a smaller fraction of the total resistance, the trip point moves down. At a selected trip point temperature $T_t$, $\Delta V_{be}$ is equal to $(kT_t/q)\ln(J_4/J_8)$. To set the trip point at $T_t$, the ratio of R5 to R6 is set so that the resulting fraction of $V_{be4}$ just equals $\Delta V_{be}$ at $T_t$. The embodiment of the thermal shutdown circuit shown in FIG. 4 is preferred, because making the well-controlled current from Q9 equal to the current in Q4 provides a convenient way to set the ratio of the currents so that it is temperature independent.

The two transistors Q4 and Q8 should be placed together in close proximity to the point or device to be monitored for excessive temperature. For example, if Q4, Q8 and a voltage regulator's pass transistor are placed together in close proximity, the thermal shutdown circuit generates a signal at node 82 when the pass transistor's temperature exceeds the selected trip point temperature.

Note that the current density ratio of four found in this embodiment is not a hard constraint. Design tradeoffs may affect the ratio chosen: larger ratios provide better performance and a more abrupt threshold, but require more surface area on the I.C. die. In fact, it is not necessary that Q8 and Q4 be differently-sized at all: if Q8 and Q4 are the same size, a trip point could still be established by making R7 and R2 have different values, or having Q9 and Q3 differently-sized.

Some clamping mechanism should be employed to prevent the node 82 voltage from rising high enough to saturate Q9, which could excessively load current mirror 58 by taking away a large fraction of the current intended for Q7. For example, a pair of diodes D1 and D2 connected in series between node 82 and V− would suffice (for V+ greater than about 2 volts), assuming that the voltage required by the circuitry which is driven by node 82 is low.

Another possible implementation of current-limiting circuit 64 is shown in FIG. 4. A pair of transistors J1 and J2 are connected in series between the START signal and the base of Q1, with a resistor R8 optionally connected between them. The transistors are preferably field-effect transistors (FETs) operated at $I_{DSS}$—preferably depletion mode MOSFETs or J-FETs constructed as base pinch resistors—which act as high value resistors at low applied voltages. However, at higher voltages, J1 and J2 pinch off to a limiting current—making them nearly ideal for this application. When the START signal first begins to increase, the current through J1 and J2 also increases so that the voltage at the base of Q1 follows START. Once START has increased enough to turn the bias currents "on", J1 and J2 pinch off, permitting only a relatively constant, limited current to pass onto Q1 and Q5 and thus limiting the amount of current Q5 must carry to hold Q1 at equilibrium.

Because the J-FETs break down at a fairly low voltage, two J-FETs are used to accommodate the permitted voltage range of the START signal. If the START signal voltage exceeds the breakdown voltage of one of the J-FETs, the current delivered to Q1 is limited to that supplied by the other J-FET. Added protection is provided by inserting resistor R8 between J1 and J2. R8 limits the current to Q1 if the START signal voltage goes beyond the combined breakdown voltages of J1 and J2.

In implementing current-limiting circuit 64, J-FETs J1 and J2 are preferred over a large resistance. The J-FETs occupy less area on an I.C. die than do large value thin film resistors, and they perform better by limiting the current delivered to Q1 to an almost constant value when their pinch-off voltages are exceeded, thereby further reducing the start-up circuit's sensitivity to variations in the START signal.

Figure 1:
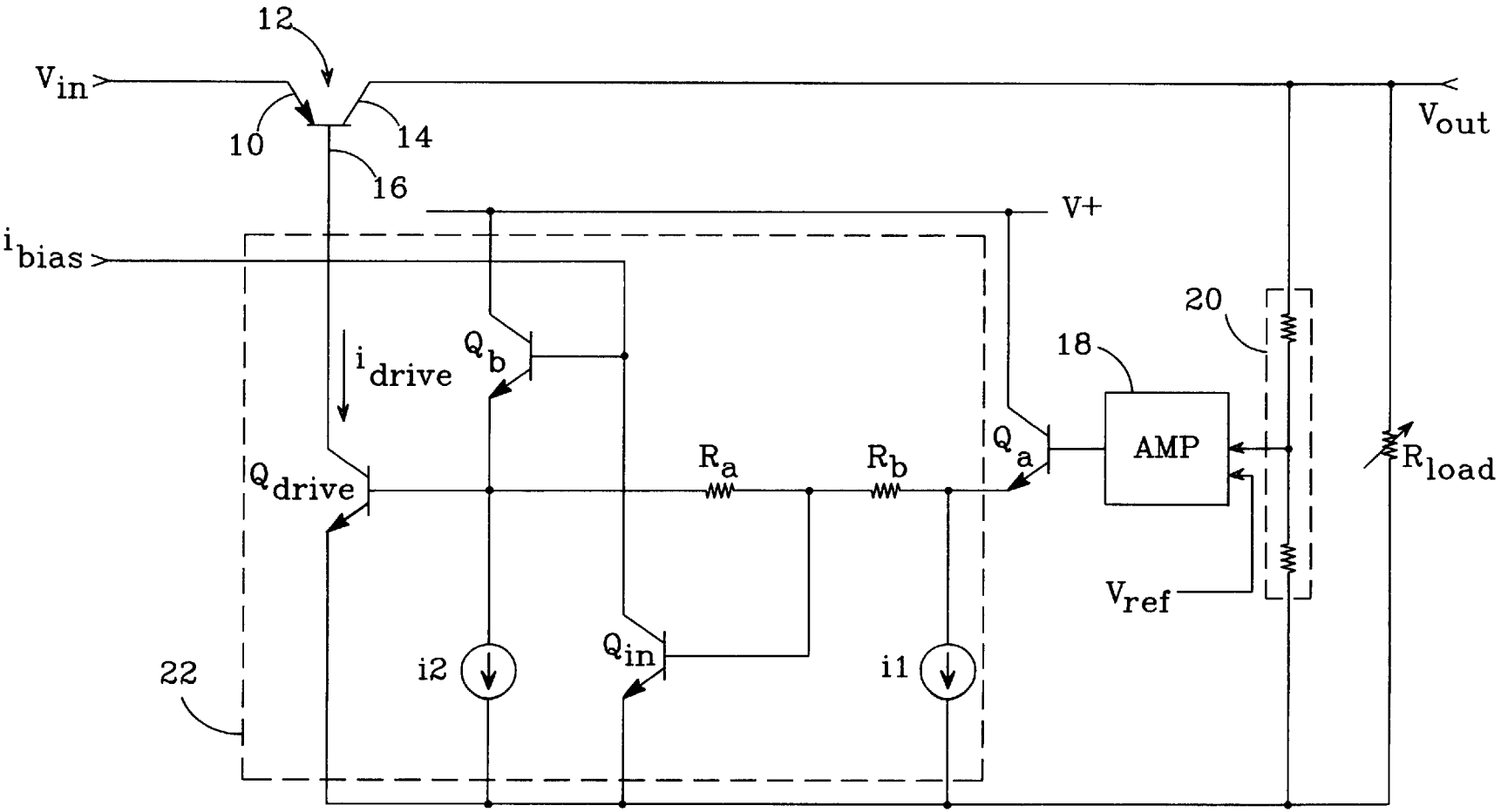
FIG. 1 (Prior Art)
FIG. 1 is a schematic diagram of a prior art voltage regulator.
Figure 5:
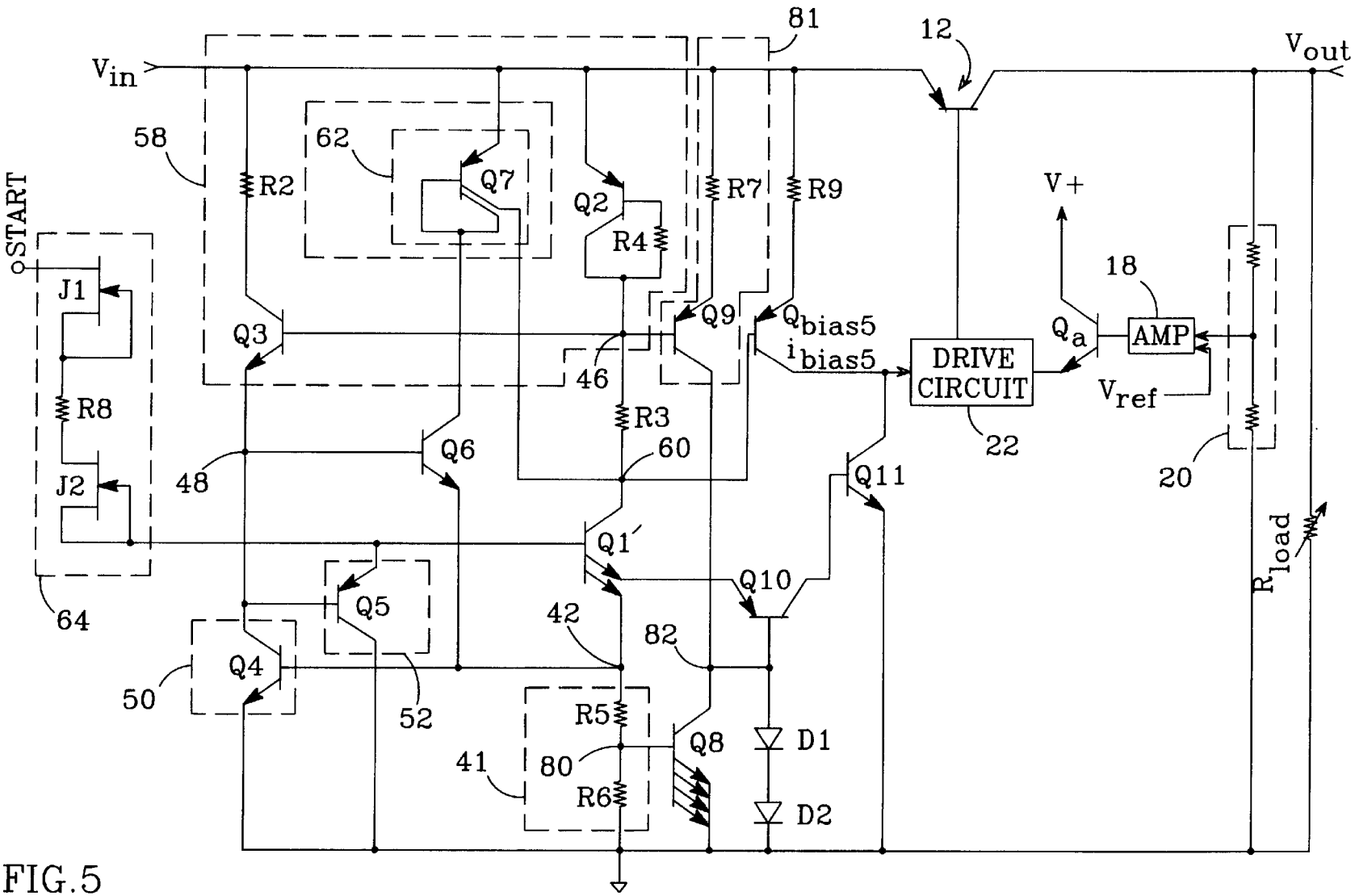
FIG. 5 is a schematic diagram of a voltage regulator incorporating a start-up and bias circuit and a thermal shutdown circuit per the present invention.

A typical application of the start-up and bias circuit is shown in FIG. 5, where it is used to provide bias current to the voltage regulator circuit of FIG. 1. The thermal shutdown circuit described above is also employed to protect pass transistor 12. The base of a transistor $Q_{bias5}$ is connected to the start-up and bias circuit's fixed bias point 46, and $Q_{bias5}$'s emitter is connected to the regulator's input voltage $V_{in}$ via a resistor R9. A bias current $i_{bias5}$ to produces at $Q_{bias5}$'s collector that is "on" and fixed when the current through Q1 (Q1' in FIG. 5) reaches the threshold value $i_{th}$. Here, the START signal is used to activate the voltage regulator, which produces a regulated output $V_{out}$ when $i_{bias5}$ comes "on".

Two transistors Q10 and Q11 are used to interface excessive temperature indication node 82 to the regulator. Q1 is here implemented with a dual-emitter transistor Q1'. The base of transistor Q10 is connected to node 82, and its emitter is connected to one of the emitters of Q1'. Q10's collector drives the base of transistor Q11, which has its current circuit connected between $i_{bias5}$ and ground.

Transistors Q4 and Q8 are placed in close proximity to pass transistor 12, which is typically the main power dissipating transistor in a voltage regulator. When the pass transistor is operating in its normal temperature range—below the trip temperature $T_t$ established by R5, R6, Q4 and Q8—node 82 is high, Q10 and Q11 are off, and $i_{bias5}$ is delivered to the regulator's drive circuit 22. However, if the temperature of pass transistor 12 exceeds the trip temperature $T_t$, node 82 falls. This biases Q10 on, which connects the base of Q11 to an emitter of Q1'. When the bias currents are "on", the base of Q1 is at about $2\times V_{be}$. Thus, when node 82 falls, Q11 is turned on and diverts current $i_{bias5}$ from drive circuit 22. This cuts off the drive to pass transistor 12, which protects the transistor and effectively shuts down the regulator.

The use of transistors Q10 and Q11 as shown in FIG. 5 is merely one example of an interface to node 82. There are many other ways in which the excessive temperature indicating function of node 82 might be employed.

Similarly, FIG. 5's use of the start-up and bias circuit in a voltage regulator is also intended as only an example. Many other types of circuitry require one or more fixed bias currents for their operation, which become active upon receipt of an initialization signal analogous to START. The novel start-up and bias current and thermal shutdown circuits described herein would be useful for many of these circuits.

While particular embodiments of the invention have been shown and described, numerous variations and alternate embodiments will occur to those skilled in the art. Accordingly, it is intended that the invention be limited only in terms of the appended claims.

I claim:

1. A start-up circuit which provides a fixed bias point suitable for generating fixed bias currents for use in other circuits, comprising:

a first transistor connected to receive a start-up signal, said start-up signal having off and on states, and to conduct a first current in response when said start-up signal is in said on state, said first current mirror circuit connected to mirror said first current to produce a first mirrored current, a current sink circuit connected to sink all of said first mirrored current when said first current reaches a predetermined threshold, and a current diversion circuit connected to said start-up signal and arranged to divert from said first transistor a current that varies with the magnitude of the current sunk by said current sink circuit so as to oppose increases in said start-up signal beyond that required to maintain said first current at said predetermined threshold, said first current thereby becoming fixed at said predetermined threshold and providing a fixed bias point that is largely immune to variations in said start-up signal above the level corresponding to said threshold when said start-up signal is in said on state, said fixed bias point suitable for generating fixed bias currents for use in other circuits, said fixed bias point and thereby said fixed bias currents not provided when said start-up signal is in said off state.

2. The start-up circuit of claim 1, wherein said current sink circuit is a transistor which conducts a current that varies with said first current.

3. The start-up circuit of claim 1, wherein said current diversion circuit is a transistor which conducts a current that varies with the magnitude of the current sunk by said sink circuit.

4. The start-up circuit of claim 1, wherein said first transistor has a current circuit having first and second terminals and a control input, said current circuit's first terminal connected to said first current mirror circuit at a first node, and further comprising a first resistance connected between said first current circuit's second terminal at a second node and a circuit common point, said second node connected to drive said current sink circuit to sink said first mirrored current and said first node being said fixed bias point.

5. The start-up circuit of claim 4, wherein said first current mirror circuit comprises second and third transistors connected in a Widlar mirror configuration, with the current circuit of said second transistor connected to said first node and the current circuit of said third transistor connected to mirror the current through said first transistor to said current sink circuit.

6. The start-up circuit of claim 4, wherein said current sink circuit is a second bipolar transistor and the operating point of said first transistor is stabilized when said second transistor is driven to sink all of said first mirrored current, said stabilization occurring when the current through said first transistor is equal to the base-emitter voltage of said second bipolar transistor divided by the resistance value of said first resistance.

7. The start-up circuit of claim 4, further comprising a second transistor connected to conduct a current in response to said first mirrored current, and a second current mirror circuit connected to mirror said current conducted by said second transistor to the current circuit of said first transistor, thereby limiting the amount by which said first mirrored current increases in response to increases in said start-up signal when said start-up signal is at low levels and extending the start-up signal range over which said first node is well below said fixed bias point.

8. The start-up circuit of claim 7, wherein said second mirror circuit comprises a split-collector bipolar transistor, with its first collector connected to its base and to said second transistor, and its second collector connected to said first node.

9. The start-up circuit of claim 4, further comprising at least one additional transistor connected to said fixed bias point to mirror the current in said first transistor and thereby provide a fixed bias current for another circuit when the current in said first transistor is at said predetermined threshold.

10. The start-up circuit of claim 1, further comprising a current limiting circuit connected between said start-up signal and the control input of said first transistor to limit the current delivered to said first transistor and thereby prevent an uncontrolled current in said first transistor.

11. The start-up circuit of claim 1, wherein said current sink circuit is a second bipolar transistor and further comprising a resistance network connected between said first transistor's current circuit at a first node and a circuit common point, said second transistor connected to conduct current in response to the voltage at said first node, and further comprising a third bipolar transistor having its base connected to an interior node of said resistance network such that said third transistor's base-emitter voltage is a fixed fraction of said second transistor's base-emitter voltage, said third transistor's collector connected to a fixed current source at a second node, said interior node voltage, said fixed current source and said third transistor arranged such that when below a predetermined temperature said third transistor conducts less than the current available from said fixed current source causing the voltage at said second node to rise, and when at or above said predetermined temperature said third transistor conducts all of the current available from said fixed current source causing the voltage at said second node to fall, said falling of said second node voltage suitable for indicating the occurrence of said predetermined temperature.

12. The start-up circuit of claim 11, wherein said fixed current source comprises a transistor connected to mirror said first current to said third transistor.

13. The start-up circuit of claim 12, wherein said fixed current source is arranged to produce a mirrored current about equal to said first mirrored current.

14. The start-up circuit of claim 11, wherein said third transistor has a greater emitter area than said second transistor.

15. The start-up circuit of claim 11, wherein said third transistor has an emitter area greater than that of said second transistor and said fixed current source is arranged to provide a current about equal to said first mirrored current, said emitter area ratio and said interior node voltage arranged such that when the current in said first transistor is at said predetermined threshold and said second and third transistors are at said predetermined temperature the currents in said second and third transistors become substantially equal and thereby cause the voltage at said second node to fall.

16. A start-up circuit which provides a fixed bias point suitable for generating fixed bias currents for use in other circuits, comprising:

a first transistor having a control input connected to receive a start-up signal and a current circuit with first and second terminals, said start-up signal having off and on states, said first transistor conducting a first current in response to said start-up signal when said start-up signal is in said on state, a first current mirror circuit connected to said first terminal at a first node and arranged to mirror said first current to produce a first mirrored current, a resistance connected between said second terminal at a second node and a circuit common point, a second transistor having a control input connected to said second node and a current circuit connected to said first current mirror circuit, said second transistor sinking all of said first mirrored current when said first current reaches a predetermined threshold, and a third transistor having a control input that varies with the magnitude of said current sunk by said second transistor and a current circuit connected between said start-up signal and said circuit common point, said third transistor diverting current from the control input of said first transistor that is in excess of that required to maintain said first current at said predetermined threshold, said first current thereby becoming fixed at said predetermined threshold and providing a fixed bias point suitable for generating fixed bias currents for use in other circuits that is largely immune to variations in said start-up signal as long as said start-up signal is in said on state and adequate to maintain said first current at said predetermined threshold, said fixed bias point and thereby said fixed bias currents not provided when said start-up signal is in said off state.

17. The start-up circuit of claim 16, wherein said second transistor is a bipolar transistor and the operating point of said first transistor is stabilized when said second transistor is driven to sink all of said first mirrored current, said stabilization occurring when the current through said first transistor is equal to the base-emitter voltage of said second transistor divided by the resistance value of said first resistance.

18. The start-up circuit of claim 16, further comprising a current limiting circuit connected between said start-up signal and said first transistor which limits the current applied to said first transistor's control input to prevent an uncontrolled current in said first transistor.

19. The start-up circuit of claim 18, wherein said current limiting circuit comprises a resistance.

20. The start-up circuit of claim 18, wherein said current limiting circuit comprises at least one fieldeffect transistor (FET) operated at $I_{DSS}$ which pinches off to limit the start-up signal current when said start-up signal exceeds a predetermined voltage.

21. The start-up circuit of claim 20, wherein said current-limiting circuit comprises two series-connected FETs to extend the voltage range of said start-up signal that can be received without exceeding the FETs' respective breakdown voltages.

22. The start-up circuit of claim 21, further comprising a resistor connected in series between said series-connected FETs to limit the current delivered to said first transistor if the voltage of said start-up signal exceeds the combined breakdown voltages of said FETs.

23. The start-up circuit of claim 16, further comprising a fourth transistor connected to conduct a current in response to said first mirrored current, and a second current mirror circuit connected to mirror said current conducted by said fourth transistor to the current circuit of said first transistor, thereby limiting the amount by which said first mirrored current increases in response to increases in said start-up signal when said start-up signal is at low levels and extending the start-up signal range over which said first node is well below said fixed bias point.

24. The start-up circuit of claim 16, wherein said second transistor is a bipolar transistor and said resistance comprises a resistance network connected between said second node and a circuit common point, said second transistor connected to conduct current in response to the voltage at said second node, and further comprising a fourth bipolar transistor having its base connected to an interior node of said resistance network such that said fourth transistor's base-emitter voltage is a fixed fraction of said second transistor's base-emitter voltage, said fourth transistor's collector connected to a fixed current source at a third node, said interior node voltage, said fixed current source and said fourth transistor arranged such that when below a predetermined temperature said fourth transistor conducts less than the current available from said fixed current source causing the voltage at said third node to rise, and when at or above said predetermined temperature said fourth transistor conducts all of the current available from said fixed current source causing the voltage at said third node to fall, said falling of said third node voltage suitable for indicating the occurrence of said predetermined temperature.

25. The start-up circuit of claim 24, wherein said fourth transistor has an emitter area greater than that of said second transistor and said fixed current source is arranged to provide a current about equal to said first mirrored current, said emitter area ratio and said interior node voltage arranged such that when the current in said first transistor is at said predetermined threshold and said second and fourth transistors are at said predetermined temperature the currents in said second and fourth transistors become substantially equal and thereby cause the voltage at said third node to fall.

26. The start-up circuit of claim 16, further comprising at least one additional transistor connected to said fixed bias point to mirror said first current and thereby provide a fixed bias current suitable for use by another circuit when said first current is at said predetermined threshold.

27. A voltage regulator which includes a start-up and bias circuit, comprising:

a voltage regulator, comprising:

a pass transistor connected between an input voltage terminal and an output voltage terminal which produces an output voltage at said output voltage terminal in accordance with a drive current received at its control input and an input voltage received at said input voltage terminal, a drive circuit connected to supply said drive current to said pass transistor in accordance with an error voltage received at a first input and a bias current received at a second input, a loop amplifier connected to supply said error voltage to said drive circuit in accordance with a feedback voltage received at a loop amplifier input, and a feedback network connected between said output voltage terminal and said loop amplifier input and supplying said feedback voltage to said amplifier, said feedback network, loop amplifier and drive circuit forming a feedback loop that regulates said output voltage, a start-up and bias circuit, comprising:

a first transistor connected to receive a start-up signal and to conduct a first current in response, a mirror circuit connected to mirror said first current to produce a first mirrored current, a second transistor connected to sink all of said mirrored current when said first current reaches a predetermined threshold, and a third transistor having a current circuit connected to said start-up signal and conducting a current that varies with said current sunk by said second transistor, said third transistor thereby opposing increases in said start-up signal beyond that required to maintain said first current at said predetermined threshold, said first current thereby becoming fixed at said predetermined threshold and providing a fixed bias point that is largely immune to variations in said start-up signal as long as said start-up signal is adequate to maintain said first current at said predetermined threshold, and a fourth transistor connected to said fixed bias point to mirror said first current to said drive circuit, said current mirrored by said fourth transistor being said bias current.

28. The voltage regulator of claim 27, wherein said second transistor is a bipolar transistor and further comprising a resistance network connected between said first transistor's current circuit at a first node and a circuit common point, said second transistor connected to conduct current in response to the voltage at said first node, and further comprising a fifth bipolar transistor having its base connected to an interior node of said resistance network such that said fifth transistor's base-emitter voltage is a fixed fraction of said second transistor's base-emitter voltage, said fifth transistor's collector connected to a fixed current source at a second node, said interior node voltage, said fixed current source and said fifth transistor arranged such that when below a predetermined temperature said fifth transistor conducts less than the current available from said fixed current source causing the voltage at said second node to rise, and when at or above said predetermined temperature said fifth transistor conducts all of the current available from said fixed current source causing the voltage at said second node to fall, said falling of said third node voltage suitable for indicating the occurrence of said predetermined temperature, and further comprising a bias currentreducing circuit connected to said second node which reduces the bias current delivered to said drive circuit in response to the falling of said second node voltage.

29. The voltage regulator of claim 28, wherein said fifth transistor has an emitter area greater than that of said second transistor and said fixed current source is arranged to provide a current about equal to said first mirrored current, said emitter area ratio and said interior node voltage arranged such that when the current in said first transistor is at said predetermined threshold and said second and fifth transistors are at said predetermined temperature the currents in said second and fifth transistors become substantially equal and thereby cause the voltage at said second node to fall.

30. The voltage regulator of claim 28, wherein said first transistor is a dual-emitter transistor and said bias current-reducing circuit comprises sixth and seventh transistors, said sixth transistor having its control input connected to said second node and its current circuit connected between an emitter of said first transistor and the control input of said seventh transistor, the current circuit of said seventh transistor connected between said bias current and a circuit common point such that said bias current is diverted to said circuit common point when said second node voltage falls.

* * * * *